United States Patent [19]

Timour

[11] 4,027,644

[45] June 7, 1977

[54] ISOLATED ENGINE COVER

[75] Inventor: Sune E. Timour, Columbus, Ind.

[73] Assignee: Cummins Engine Company, Inc., Columbus, Ind.

[22] Filed: June 26, 1975

[21] Appl. No.: 590,708

[52] U.S. Cl. ..... 123/198 E; 123/90.38; 123/195 C; 123/195 S; 181/33 K

[51] Int. Cl.[2] ..... F02B 77/00

[58] Field of Search ..... 123/198 E, 90.38, 195 C, 123/195 S; 181/33 K

[56] References Cited

UNITED STATES PATENTS

| | | | |
|---|---|---|---|
| 2,724,378 | 11/1955 | Wellman | 123/198 E |
| 3,396,712 | 8/1968 | Sakraida et al. | 123/198 E |
| 3,656,466 | 4/1972 | Dzus | 123/198 E |
| 3,773,142 | 11/1973 | Bragg et al. | 123/198 E X |
| 3,822,763 | 7/1974 | Adams et al. | 123/198 E X |
| 3,869,859 | 3/1975 | Thornburgh | 123/198 E X |
| 3,924,597 | 12/1975 | Hatz et al. | 123/198 E |

*Primary Examiner*—C. J. Husar
*Assistant Examiner*—Ira S. Lazarus
*Attorney, Agent, or Firm*—Gary M. Gron; Robert T. Ruff

[57] ABSTRACT

The disclosure illustrates an isolated rocker arm cover for an internal combustion engine. An elongated continuous elastomeric seal element extends from a groove around the periphery of the rocker arm cover. Spring loaded fastener assemblies resiliently hold the cover against the engine with a sufficient force to provide an effective oil seal but still maintain the cover isolated from the engine. The seal element has a configuration assuring a narrow contact area between the ring and the engine.

22 Claims, 7 Drawing Figures

FIG 2
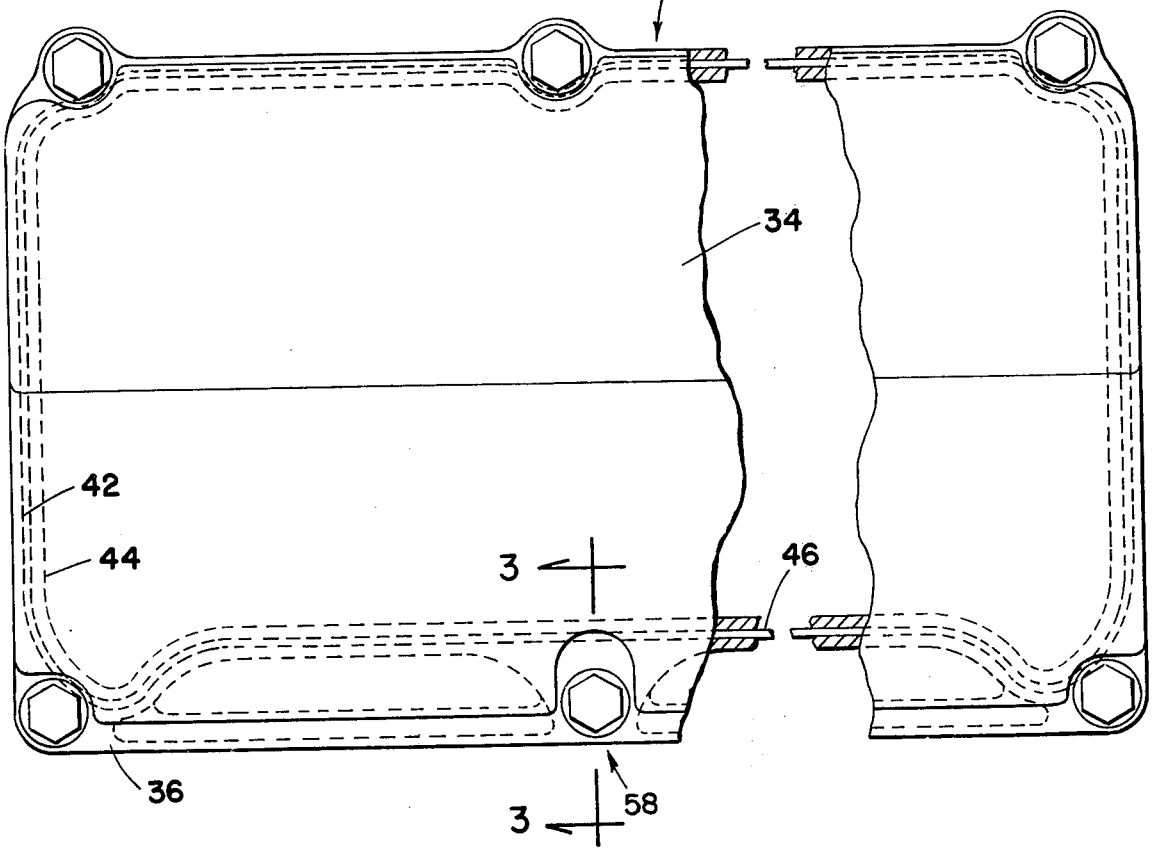
FIG 3
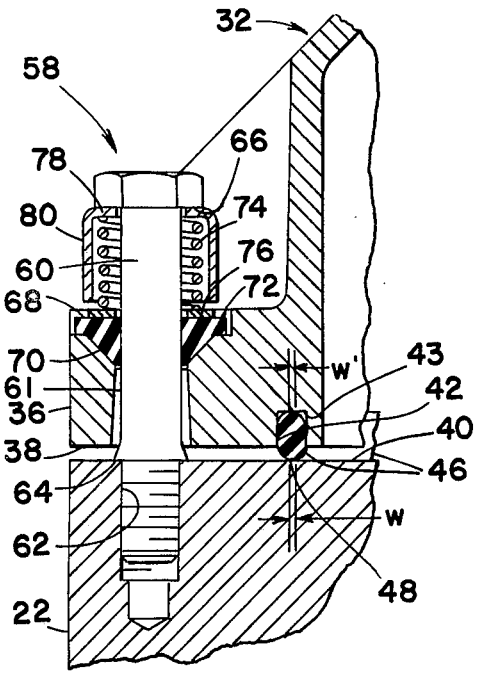
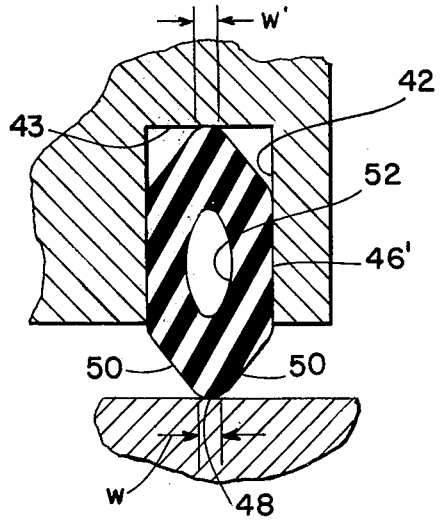
FIG 4

FIG 5
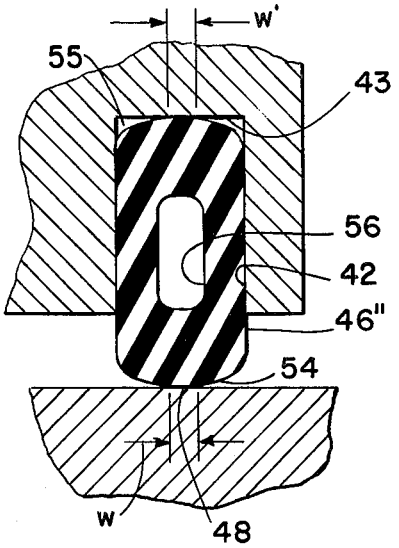
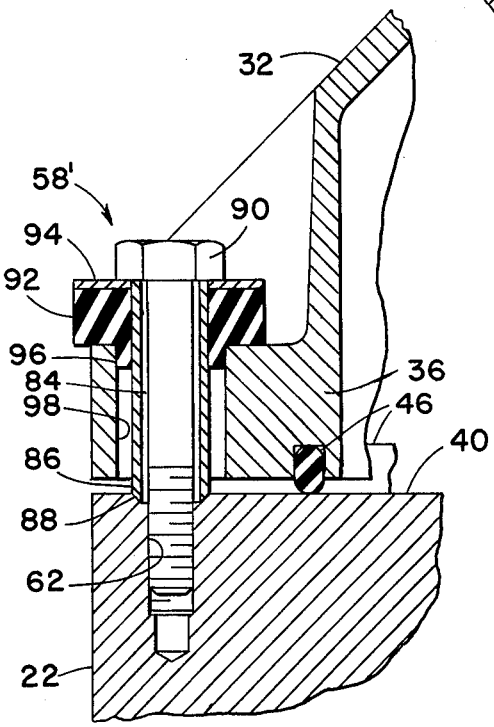
FIG 6
FIG 7
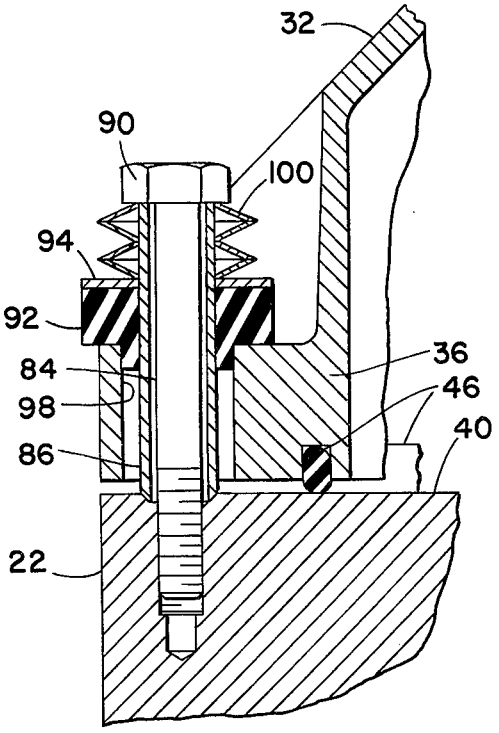

ISOLATED ENGINE COVER

The current emphasis on environmental considerations has prompted a significant amount of development work into methods and schemes for minimizing diesel engine noise. The noise emitted from a diesel engine originates with several exciting forces, namely combustion and mechanical. These forces cause deflections in the engine structure which responds in its natural modes of vibration to produce noise. However, the structure in turn excites the non-loaded carrying covers, such as the rocker arm covers, to vibrate and emit noise.

In the past, many approaches have been tried to isolate various engine covers from the engine structure to prevent them from transmitting noise. An early approach may be found in the patent to Lynd U.S. Pat. No. 1,737,466. More recent examples may be found in the U.S. Pat. Nos. to Vickers et al. 3,692,335, Bragg et al. 3,773,142, Adams et al. 3,822,763, and Thien et al. 3,695,386. While these recent developments do reduce noise by isolating engine covers they do so at a substantially increased manufacturing cost.

Most, if not all of the above patents, require the bonding of an elastomeric element to the engine cover. This bonding process, which is needed to reduce the potential leakage paths, represents a significant expense. Furthermore they utilize a gasket for sealing which has a substantial contact area. As a result excessive forces are required to be exerted by a fastening device to maintain a seal at the non bonded surface.

The above problems are solved by an anti-noise cover for an internal combustion engine. The cover has a continuous perimeter groove facing towards the engine housing. An elongated elastomeric element is received throughout the length of the groove and extends from it to form a continuous ridge around the cover. The cover is yieldably urged towards the housing with a force high enough to form a seal along a band of contact between the elastomeric element and the housing and low enough to prevent contact between the cover and the engine housing.

The above and other related features of the present invention will be apparent from a reading of the following description of the accompanying drawings and the novelty thereof pointed out in the appended claims.

In the drawings,

FIG. 2 is a plan view of one of the isolated covers shown in FIG. 1;

FIG. 3 is a greatly enlarged fragmentary cross section view of the isolated rocker cover of FIG. 2 taken on line 3—3 of FIG. 2;

FIGS. 4 and 5 are cross section views of alternate configurations for a seal element incorporated in the isolated cover of FIG. 2;

FIGS. 6 and 7 show alternate fastening assemblies for yieldably urging the isolated cover towards the engine surface.

Figure 1:
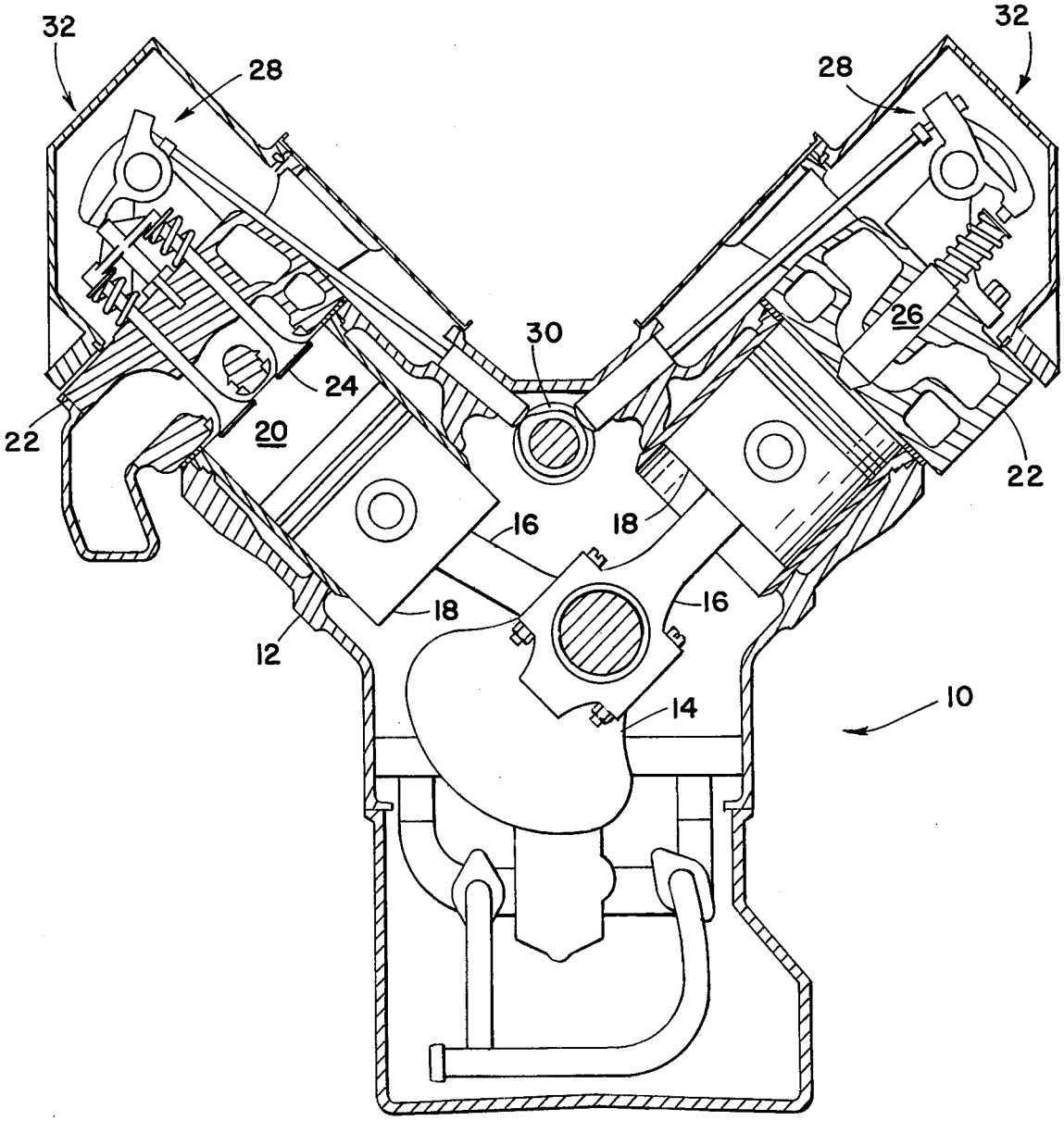
FIG. 1 is a simplified cross section view of a V-type diesel engine having an isolated cover embodying the present invention.

FIG. 1 shows a V-type engine 10 comprising a crankcase 12 having a crankshaft 14 journaled in it. Connecting rods 16 extend from throws on the crankshaft 14 to pistons 18 which reciprocate in cylinders 20. Heads 22 contain valves 24 and injectors 26 respectively controlling flow of gases into and out of the cylinders 20 and injecting fuel to produce combustion. Both the valves 24 and injectors 26 are actuated by rocker arm assemblies shown at 28 which are driven through a central camshaft 30. Rocker arm covers 32 cover the rocker arm assemblies so that the oil used to lubricate them will be retained within the engine.

As described above the noise generated in a diesel engine occurs because of the sudden increase in gas pressure in cylinders 20. In addition, mechanical noises generated by movement of the pistons 18 and rods 16 also excite the block 12. The block 12 vibrates in response to the excitation force and therefore emits noise directly. It would also cause the rocker covers 32 to vibrate making them in effect speaker diaphragms. In accordance with the present invention the rocker covers 32 are completely isolated with respect to the engine thereby greatly minimizing emitted noise.

Referring to FIGS. 2 and 3 the rocker covers 32 comprise a central cover section 34 bounded by a peripheral flange 36. Flange 36 has a perimeter face 38 which opposes and is spaced from a perimeter face 40 on the engine heads 22. A continuous groove 42 is formed around face 38 along a path closely adjacent the inner boundary 44 of face 38. A continuous elastomeric element 46 is received throughout groove 42. Element 46 may be formed from many different types of elastomeric material. One such material is extruded polysiloxane rubber available from a number of commercial sources. The flange 36 is urged towards face 40 by a fastening assembly 58 so that element 46 abuts face 40.

It is preferable that elastomeric element 46 have at least one of a number of design criteria enbling it to completely isolate cover 32 and still maintain an effective oil seal.

The criteria are as follows:

1. The free height of element 46 should be high enough so that it projects from groove 42 to form a resilient ridge 48 which maintains faces 38 and 40 out of contact with one another when element is deformed to its installed height.
2. The configuration of element 46 should be such that it presents a converging cross section in ridge 48 to define a relatively narrow band of contact between element 46 and face 40.
3. The configuration of element 46 should also be such that it presents a converging cross section in the portion of element 46 adjacent the bottom wall 43 of groove 42 to define a relatively narrow band of contact between element 46 and face 40. As a result, the upper and lower edges of element 46 form a dual sealing band around the periphery of the rocker housing 32.
4. The width $w$ of element 46 should be wide enough in relation to its height to permit stable deformation to its installed height.
5. The element 46 should be flexible enough to conform to any surface irregularities of face 40 but stiff enough to form an effective seal.

FIGS. 4 and 5 show examples of seal elements 46' and 46'' which conform to the above criteria.

FIG. 4 shows one form of the seal element 46' in which the ridge 48 has lower straight converging side walls 50 to form the width $w$ and upper converging side walls to form width $w'$. The width of element 46' is made large relative to its height to assure stable deformation. As described later, the elastomeric element 46' has a hollow core 52 throughout its length. FIG. 5 shows still another elastomeric element 48'' having a lower convex surface 54 for ridge 46 to produce a contact with w that is slightly larger than the contact width for seal element 46' but still substantially less than the maximum width of the seal element. Element 46'' has an upper convex surface 55 to produce a contact width *w*. Element 46'' also has an elongated core 56 throughout its length. This element maintains a constant distance between suface 43 and 40 regardless of twist of the element about its longitudinal axis.

Referring again to FIG. 3 the flange 36 is urged towards face 40 by the fastening assembly 58. Assembly 58 comprises a bolt extending through a hole 61 in flange 36 and threaded into a bore 62 in head 22. A shoulder 64 on bolt 60 abuts face 40 so that a fixed height is maintained between face 40 and the head of bolt 60. An elastomeric grommet 68 is received over bolt 60 and has a conical surface 70 received in a conical recess 72 on flange 36. A spring 74 acts against a washer 76 on grommet 68 and against the bolt head 66 through a flange 78. Flange 78 is integral with a cup 80 which covers and protects spring 74. The free height of cup 80 is sufficient to substantially cover spring 74 but not long enough to come in contact with washer 76 or grommet 68.

FIG. 6 shows an alternate fastening assembly 58' for urging the flange 36 towards face 40. In this embodiment a bolt 84 is threaded into the bore 62 on head 22. A tube 86 is telescoped over bolt 84 and is received at one end in a tapered shoulder 88 around bore 62 and at the other end by the head 90 of bolt 84. The tube 86 maintains the head 90 at a fixed distance from face 40. A resilient elastomeric grommet 92 acts against a washer around the head 90 and has a nose section 96 received in an opening 98 through flange 36'. In this embodiment the grommet 92 is placed in substantial compression so that it functions to yieldably urge the flange 36 towards surface 40 is addition to isolating tube 86 from the walls of hole 98. The grommet 92 is formed from elastomeric material having sufficient resiliency to function as a spring like element. The elastomeric material described above may be employed for this purpose.

FIG. 7 illustrates still another embodiment of a fastening assembly 58''. In this instance, the rubber grommet 92 functions merely to isolate the tube 86 from the walls of hole 98. The spring force is provided by a series of Bellville springs 100 acting on the bolt head 90 and on washer 94.

In all of the embodiments described above there are two key elements. The first is the elastomeric seal element extending around the periphery of the cover and the second is the fastener for yieldably urging the flange toward the engine face 40. In each case the actual upper and lower width for the band of contact along the seal is relatively narrow to enable the generation of substantially high unit forces over the contact area without the need to apply excessive compressive loads. The high unit force is necessary to obtain an effective perimeter seal at the interface between the element 46 and face 40. It should be noted that the upper band of contact between element 46 and the base wall 43 of groove form a corresponding perimeter seal providing a seal at essentially two points, when viewing the element 46 in cross section, insuring that the seal will be maintained even if the cover 32 is shifted laterally during engine operation. Furthermore, with this design the element 46 may be loosely received in groove 42 since there is no need to form an effective seal along the side walls of the groove.

Since the width of element 46 is large in relation to its height deformation of the element 46 is stable, that is, it does not bend to one side of the groove 42 as it is compressed against face 40. Stable deformation is also aided by the hollow center section which produces a bridge type of support for the ridge 48 of the element 46.

The element 46 is made flexible to conform to any surface irregularities of groove 42 and face 40. This is done primarily be reducing the cross sectional area of element 46 to enable a greater deformation for a given force than that for a solid element. In addition, the hollow section changes the deformation from pure compression to compression and bending which also increases flexibility. This enables the use of an elastomeric material having a relatively high hardness (e.g., durometer hardness of 55–60 or greater) to a hardness which permits great flexibility in the element 46 to form an effective sealing surface. If a soft rubber of solid section were to be selected, the plasticizers can leach out and in time the material would become hard and brittle thus failing to perform as a seal. However, with the hollow center section in each of the seal elements the rubber is resilient enough to conform to any irregularities in the surface and yet hard enough to stand up over time.

The fastening assemblies urge the flange 36 towards the surface 40 with a sufficient force to provide an effective seal. As pointed out above the tapered cross section for the element 46 permits a modest application of force and still maintain high enough unit forces to form a seal. Since the seal element 46 is positioned adjacent the inner boundary 44 of flange 36 it is well protected from engine heat. Since fastening assemblies 58 are outside of the perimeter seal, there are no secondary points where leakage can occur. Furthermore the cup 80 adequately protects the spring 74 on the fastening assembly 58 from the environment in the engine compartment.

All of the seal elements above effectively isolate the rocker covers 32 from the engine while at the same time maintaining a highly effective oil seal. The provision of this type of isolated rocker cover produces a substantial reduction in noise emitted by an engine without the substantial cost of prior art isolated schemes. The seal element 46 is simply received in the groove in the rocker cover and held in place by compression. No bonding or special treatment is required to keep the gaskets in place.

While the preferred embodiments of the present invention have been described it should be apparent to those skilled in the art that it may be employed in different forms without departing from its spirit and scope.

Having thus described the invention what is claimed as novel and desired to be secured by letters patent of the United States is:

1. In an interanl combustion engine having a housing, an anti-noise cover assembly comprising:

a cover adapted to be placed over said housing;

means forming a continuous perimeter groove on said cover, said groove facing towards said housing;

an elongated elastomeric element received thoughout the length of said groove; said element in its free state extending out of said groove to form a continuous ridge around said cover; and, means connectable with said housing for yieldably urging said cover towards said housing high enough to form a seal along a band of contact between said elastomeric element and said housing and low enough to prevent contact between said cover and said housing, said cover being spaced from said housing;

whereby said cover is sound insulated with respect to said engine.

2. Apparatus as in claim 1 wherein said yieldable urging means is positioned outside of said perimeter groove.

3. Apparatus as in claim 1 wherein said elastomeric element has a relatively narrow contact area with said housing whereby a substantial pressure along the band of contact between said element and housing is attainable with a minimum force from said yieldable urging means.

4. Apparatus as in claim 3 wherein said elastomeric element has a convex cross sectional configuration for the portion of said element extending from said groove thereby providing said relatively narrow contact area.

5. Apparatus as in claim 4 wherein said elastomeric element has a convex cross sectional configuration for the portion of said element received in said groove to form a narrow contact area along the base wall of said groove.

6. Apparatus as in claim 3 wherein said elastomeric element has a generally straight sided converging cross sectional configuration for the portion of the element extending from said groove thereby providing said relatively narrow contact area.

7. Apparatus as in claim 6 wherein said elastomeric element has a generally straight sided converging cross sectional configuration for the portion of said element received in said groove to form a narrow contact area along the base wall of said groove.

8. Apparatus as in claim 3 wherein said elongated elastomeric element is formed with a given hardness, said elastomeric material having a hollow center section extending substantially throughout its length whereby the effective hardness of said material is lowered to increase the sealing effectiveness thereof.

9. Apparatus as in claim 1 wherein said yieldable urging means:

comprises at least one rigid element releasably securable to said housing, said element having an abutment spaced from and facing said housing;

means for maintaining said abutment at a fixed distance from said housing;

means providing an elsastomeric barrier between said element and said cover; and, a flexible element acting on said shoulder and said barrier means for yieldably urging said cover toward said housing.

10. Apparatus as in claim 9 wherein said flexible element comprises a spring acting on said abutment and said elastomeric barrier means.

11. Apparatus as in claim 10 wherein:

said cover has at least one opening;

said rigid element comprises a shaft extending through said opening and having a shoulder forming said abutment;

said barrier means comprises an elastomeric grommet positioned over said shaft and being piloted about the opening through said cover; and, said spring is positioned about said shaft.

12. Apparatus as in claim 11 further comprising a cup surrounding said shaft and positioned over said spring to form a housing therefor, the height of said cup being less than the height of said spring when said shoulder is at said fixed distance.

13. Apparatus as in claim 9 wherein:

said cover has at least one opening;

said rigid element comprises a shaft extending through said opening and having a shoulder forming said abutment, said flexible element comprises an elastomeric collar surrounding said shaft and acting on said shoulder and said cover.

14. Apparatus as in claim 13 wherein said elastomeric collar has means formed on said collar and received in said hole thereby forming said barrier means.

15. Apparatus as in claim 9 wherein;

said cover has at least one opening;

said rigid element comprises a shaft extending through said opening and having a shoulder forming said abutment;

said flexible element comprises one or more flexible Bellville washers positioned over said shaft and acting against said shoulder and said barrier means for urging said cover toward said housing.

16. Apparatus as in claim 9 wherein;

said element comprises a shaft threadedly secured to said housing, said shaft having a shoulder forming said abutment; and, said distance maintaining means comprises a sleeve telescoped over said shaft and having a length equal to said fixed distance whereby said shaft is threaded so that said shoulder abuts said sleeve.

17. Apparatus as in claim 1 wherein said cover is a rocker assembly cover having a perimeter flange thereon, said groove being formed around said flange.

18. Apparatus as in claim 17 wherein:

said perimeter flange has an inner and outer boundary; and, said groove is positioned adjacent said inner boundary, whereby said elastomeric element is shielded from heat generated in the vicinity of said engine.

19. Apparatus as in claim 18 wherein said yieldable urging means acts on said flange to urge said cover and said housing towards one another.

20. Apparatus as in claim 19 wherein said yieldable urging means is positioned outside of said perimeter groove.

21. In combination;

an area to be covered on an internal combustion engine housing, said area having a perimeter;

a cover positioned over said area and having a perimeter generally coincident with the perimeter of said area;

means forming a continuous perimeter face on one of said perimeters;

means forming a continuous perimeter groove on the other of said perimeters, said groove being positioned to oppose said perimeter face:

an elongated elastomeric element received throughout said continuous groove and having a free height extending out of said groove to form a continuous ridge along said groove;

means for yieldably urging said groove forming means and said perimeter face towards one another with a level of force high enough to provide a seal along a line of contact between said elastomeric element and perimeter face and low enough to prevent contact between said cover and said engine, said cover being spaced from said housing.

22. Apparatus as in claim 21 wherein said elongated resilient element has a relatively narrow contact area with said perimeter face whereby a substantial pressure along the line of contact between said element and housing is attainable with a minimum force from said yieldable urging means.

* * * * *